United States Patent [19]

Bopst, III

[11] 4,174,249

[45] Nov. 13, 1979

[54] SYSTEM FOR INSTANTANEOUS SEALING OF CRACKED LINES IN PLASTER

[76] Inventor: John H. Bopst, III, 409 Chalfonte Dr., Baltimore, Md. 21228

[21] Appl. No.: 835,458

[22] Filed: Sep. 22, 1977

[51] Int. Cl.[2] ..... B30B 15/34; B32B 31/20

[52] U.S. Cl. ..... 156/577; 156/579; 156/583.1

[58] Field of Search ..... 156/523, 574, 577, 579, 156/583, 233, 526, 527, 306, 545; 428/344, 347

[56] References Cited

U.S. PATENT DOCUMENTS

| | | | |
|---|---|---|---|
| 2,192,634 | 3/1940 | Blomquist | 156/523 |
| 2,305,105 | 12/1942 | Patasnik | 156/527 |
| 2,484,566 | 10/1949 | Hiller et al. | 156/579 |
| 2,566,794 | 9/1951 | Debing | 428/344 |
| 2,684,918 | 7/1954 | Oughton | 428/344 |
| 3,393,114 | 7/1968 | Jorgensen | 156/577 |
| 3,619,333 | 11/1971 | Mender | 156/583 |
| 3,709,760 | 1/1973 | Knoner | 156/579 X |
| 3,761,334 | 9/1973 | Zondek | 156/233 X |
| 3,837,976 | 9/1974 | Davidsson | 156/577 X |

*Primary Examiner*—Michael G. Wityshyn
*Attorney, Agent, or Firm*—John F. McClellan, Sr.

[57] ABSTRACT

Apparatus for instantaneously sealing cracks in plaster and similar materials includes an electric iron of particular configuration for deploying and applying heat sealable adhesive coated metallic foil over cracks; the combination of foil strength, malleability and permanence when so-applied can effectively seal even "working" structural cracks permanently.

2 Claims, 2 Drawing Figures

SYSTEM FOR INSTANTANEOUS SEALING OF CRACKED LINES IN PLASTER

This invention relates generally to sealing and specifically to a system for sealing over cracked lines in plaster and the like.

In the prior art various U.S. patents have disclosed sealing means and method including the following:

U.S. Pat. Nos. 3,837,976 to M. I. Davidson: Sept. 24, 1974

3,619,333 to D. H. Mender: Nov. 9, 1971

2,484,566 to R. W. Hiller: Oct. 11, 1949

2,123,415 to D. L. Gorbatenko: July 12, 1938

The Davidson patent discloses iron and thermal sensitive tape;

The Mender patent discloses a rectangular iron with a forward tape guide;

The Hiller patent discloses a narrow iron and mentions using it in wall and overhead strip application;

The Gorbatenko patent discloses a self-contained roller equipped tape presser with a reel of tape and means to heat the tape electrically.

However, these patent disclosures alone or in combination are believed not to provide the advantages of the present invention, particularly in sealing over structural-type cracks.

Present systems used to seal such cracks are slow in accomplishing the end result because of length of time required for application and drying and curing before paint or other coatings can be applied.

Pressure sensitive adhesive tapes have not been generally accepted because the adhesive is not always reliable and may release with age or temperature changes causing expansion or contraction of the underlying structure.

Other types of crack filling compounds that are most often used have the time-disadvantages mentioned above, and frequently are thick, bulge, crumble or fall out of the formerly filled crack on expansion and contraction of the structure defining the crack, requiring expensive and time consuming repairing and repainting long before such should be needed.

Principal objects of this invention are to provide a system of the type described which seals over structural cracks in ceilings and walls instantly and permanently, regardless of load-working or of thermal expansion and contraction working of the structure defining the crack, in the usual magnitudes of movement.

Further objects are to provide a system as described which applies a seal almost if not entirely invisible when painted to match the substrate, and with no prior training or practice by the user.

Still further objects are to provide a system as described, including apparatus which is comfortable to use, economical, durable, safe, simple and attractive in appearance.

In brief summary given for cursive descriptive purposes only and not as limitation the invention includes a special heat sealer applying heat sealable adhesive coated metallic foil carried by it.

The above and other objects and advantages of the invention will become more readily apparent on examination of the following description, in which like reference numerals designate like parts:

FIG. 2 shows the apparatus in use sealing a crack in plaster or the like.

FIG. 1 shows the relation of the parts of the invention 10.

Figure 1:
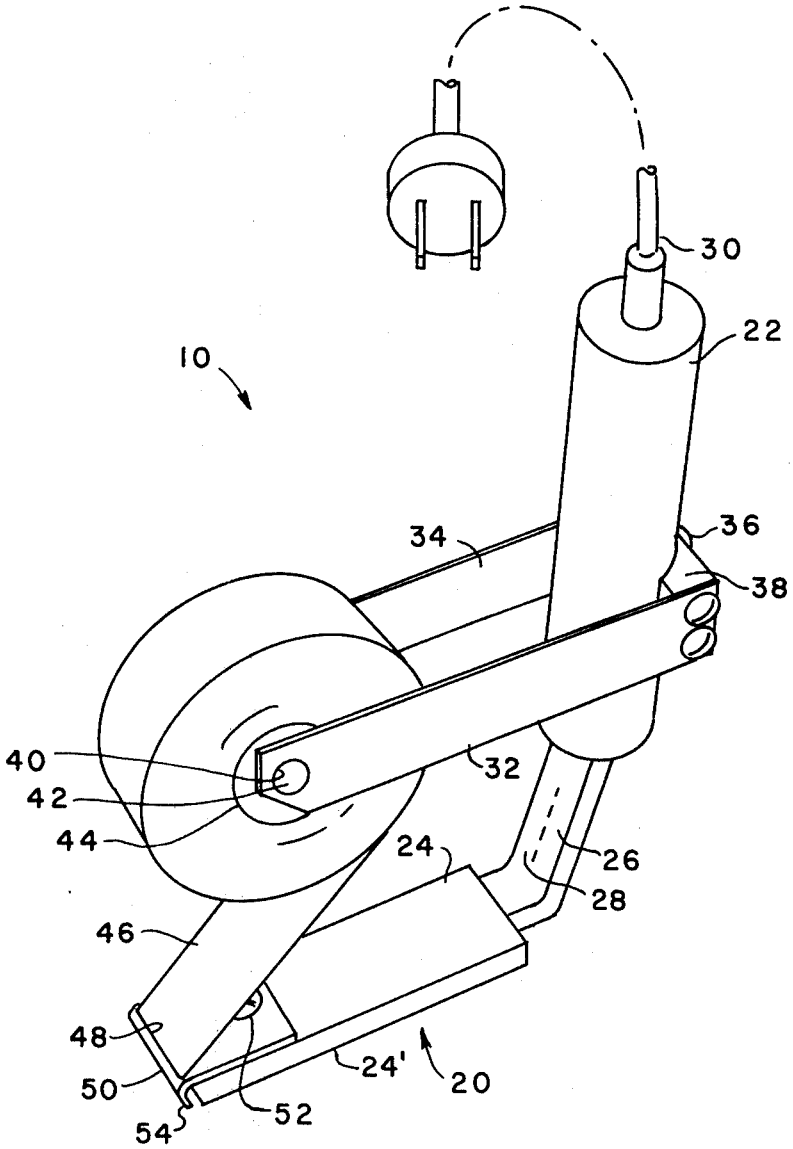
FIG. 1 is a perspective view of apparatus according to this invention.

Thermal plate 20, which is preferably generally rectangular and elongate fore-and-aft extends forward from an insulative handle 22 offset at the rear forming an angle out from the working surface 24' preferably near-perpendicular but somewhat open, approximately 95 to 100 degrees, for hand-grip clearance and all-angle visibility.

The thermal plate may advantageously comprise a housing 24 for a heated stove-type element such as "Cal-Rod", the paired ends 26, 28 of which may lead rearwardly from the housing and curve up to supportive fit within the handle.

At a point within the handle preferably, electric lead 30 may connect electrically with the sheathed element ends and lead out through the free end of the handle.

A bracket comprising preferably a pair of metallic, resilient and interchangeable arms 32, 34, preferably anchored to the handle rear intermediate portion by screws 36 holding a crosspiece 38 between them and fitting the handle, extends forwardly in spaced relation to the thermal plate and carries by means of aligned holes 40 the axle 42 of a spool 44 which can be conveniently snapped in and out for quick change by flexing the arms apart. Spools of other thicknesses (tape width) may similarly be snapped in place without change.

Coiled on the spool in a clearing position well rearward of the front end of the thermal plate for maneuvering and visual access is a supply preferably of aluminum foil tape 46 0.0005 to not substantially more than 0.002 inch (0.013 to 0.05 mm) thick and conveniently about one inch (25 mm) wide, a heat sealable coating of heat-sealable adhesive on it, coated side out relative to the thermal plate in a length leading from the rear of the coil forwardly at an angle around the front of the thermal plate through the slot 48 of a guide 50 on the thermal plate front end and rearwardly past the working face of the thermal plate. For reasons including the fact that the foil is impervious and surprisingly strong as applied, the heat sealing coating can be relatively thin by commercial standards and thus the total thickness is much thinner and less noticeable than with mesh or plastic or cloth or the like.

The guide is preferably of thin metal for good thermal conductivity and compactness, and the slot extends almost the width of the thermal plate, to which the guide is attached by a screw 52. The front end of the guide has a smooth-engagement slightly rearwardly angled extension 54 immediately over most of the front end of the thermal plate leaving room for just the thickness of the tape to pass freely through the gap between the juxtaposed heated metallic members and cause the sole or working surface of the thermal plate to hold the guide clear when on a planar surface to be repaired.

Figure 2:
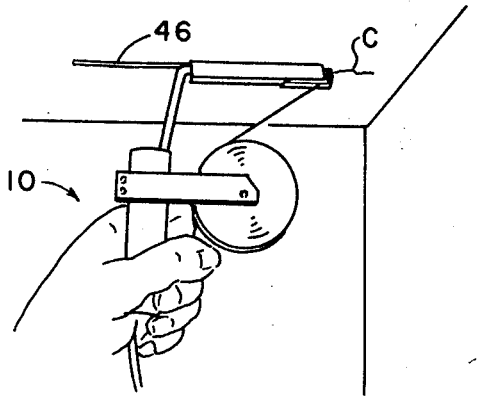

FIG. 2 shows the system 10 in operation bonding over a crack C in a ceiling, part of which has been sealed by tape 46.

Operation requires only plugging in the system electrically, waiting a couple of minutes for the thermal plate to reach full temperature and then holding the handle, pressing the angled extension 54 of the guide and the sole 24' of the thermal plate against the crack and adjacent structure, with a portion of the tape 46 between, and merely pushing the system along the cracked line, instantly and permanently sealing as it goes and automatically drawing tape off the spool as needed. Convective heating of the spooled tape in wall and ceiling work is substantially precluded by orientation because of the relation of the soleplate and spooled tape.

Heat sealable adhesive usable for the system can be any of several commonly available commercially such as No. 187601 hot melt or 5181 reactivating resin emulsion by United Resin Products, Inc., which have the characteristics that they adhere readily to metallic foil, and have relatively high melting points so that pressure to seal them is required for only a second or two at temperatures above 250° F. Sole plate temperature may be quite high; even 500° F. will not affect the foil adversely on application.

The imperviousness, conductivity and fireproof aspects of the foil facilitate uniform heating of the adhesive on application within a broad range of temperatures and protect it from atmospheric and other deteriorating agents after installation. The foil slides smoothly over the heated soleplate, making "Teflon" coating unnecessary but the soleplate can be coated if desired. Unlike plastic or cloth materials for tape, foil with adhesive resists thermal damage to a high degree, permitting the use of higher melting point adhesives, which store better on the shelf and on the apparatus, and which can be applied faster.

It will be appreciated that the invention may be practiced with metal foils having other corrosion resistant compositions and thicknesses than the example given, but still untempered. Critical to the invention are the requirements that the foil, as in the example, be thin-enough and limp enough in temper to comply with adjacent surfaces when installed and stretch across cracks without springing away, and that it elastically give and take with small changes and smoothly and malleably yield to changes exceeding the elastic modulus.

Commercially available "kitchen" type aluminum foil is a good standard of mild-temper foil useful in this system. Importantly, it will be appreciated that the relatively high expansion coefficient of the metal as compared with usual construction materials and plaster has a compensating effect. Expansion and contraction over a considerable span of ordinary building materials per unit temperature change tends to be accommodated by corresponding expansion and contraction of a shorter span of metallic foil, reducing thermal stressses in unsupported material. The high tensile strength and maleability of foil generally, tends to hold together and support substrates better for the present purpose than mesh or other materials of equal weight, while at the same time tearing free locally when accidentally snagged rather than stripping off a whole length.

Finally, it will be seen that the thinness, uniformity and smoothness of the foil permitted by the levelling and tensioning system of application makes the edges of the foil, after painting over, substantially undetectable as compared with conventional tapes and meshes.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. In a plaster crack sealing system having a thermal plate with a guide proximate the front end thereof, a handle, and a supply of tape applicable by the thermal plate, the improvement comprising: the tape being metallic foil, one face of the metallic foil having heat sealable adhesive thereon, means holding the tape coiled and spaced from the thermal plate with a free end thereof leading forwardly through the guide and rearwardly past the thermal plate, the handle providing an outwardly angled grip relative to the thermal plate, the means holding the tape including a pair of arms and a spool having means for mounting on the arms, the arms extending forwardly from the handle a distance proportioned for holding the spool rearwardly clear of the forward end of the thermal plate providing for obstruction free maneuvering and visual access in operation of the system, the guide having a slot proximate the forward end of the thermal plate, and having a portion angled over the forward end of the thermal plate and slightly to the rear leaving space only sufficient for the metallic foil to pass freely between the angled portion and the thermal plate.

2. In a plaster crack sealing system as recited in claim 1, the tape extending forwardly from the rearward edge of the spool for providing visual access during maneuvering of the system.

* * * * *